US006570315B1

(12) United States Patent
Luo et al.

(10) Patent No.: US 6,570,315 B1
(45) Date of Patent: May 27, 2003

(54) FIELD ION DISPLAY DEVICE

(75) Inventors: En ze Luo, Xi' an (CN); Hong Luo, Xi' an (CN); Wei Luo, Xi' an (CN)

(73) Assignee: Beijing New Century De'en S&T Development Co., Ltd., Beijing (CN)

( * ) Notice: Subject to any disclaimer, the term of this patent is extended or adjusted under 35 U.S.C. 154(b) by 0 days.

(21) Appl. No.: 09/701,166

(22) PCT Filed: May 12, 1999

(86) PCT No.: PCT/CN99/00068

§ 371 (c)(1),
(2), (4) Date: Nov. 22, 2001

(87) PCT Pub. No.: WO99/62095

PCT Pub. Date: Dec. 2, 1999

(30) Foreign Application Priority Data

May 22, 1998 (CN) ..... 98232734-X

(51) Int. Cl.[7] ..... H01J 29/70
(52) U.S. Cl. ..... 313/422; 313/496; 313/103 CM
(58) Field of Search ..... 313/496, 422, 313/495, 497, 103 CM, 105 CM, 365, 387, 397, 400

(56) References Cited

U.S. PATENT DOCUMENTS 3,641,341 A 2/1972 Jamba et al.
3,885,180 A * 5/1975 Carts, Jr. ..... 313/422
3,956,667 A 5/1976 Veith
4,577,133 A * 3/1986 Wilson ..... 313/103 CM
5,440,115 A * 8/1995 Bauco et al. ..... 313/103 CM
5,729,244 A 3/1998 Lockwood
5,866,901 A * 2/1999 Penn et al. ..... 313/103 CM
5,889,372 A * 3/1999 Beeteson et al. .... 313/103 CM

FOREIGN PATENT DOCUMENTS

CN 1122049 5/1996

* cited by examiner

*Primary Examiner*—Sandra O'Shea
*Assistant Examiner*—Bao Truong
(74) *Attorney, Agent, or Firm*—Fulbright & Jaworski

(57) ABSTRACT

A field ion display device comprises a field ion emission plate, a microchannel plate and a fluorescent display plate, said plates being parallel to each other, with gaps there between, and being peripherally sealed with a thin gas filled inside. The device is addressed by X-Y encoding. When a signal is applied to an addressed point, positive ions are emitted from the corresponding point on the emission plate based on the signal strength, pass through the microchannel holes, impinge on the wall of the holes, so that the emission of the multifold secondary electrons is multiplied. Said secondary electrons are accelerated by the accelerating electrode, converted into a strong electron flow, extracted from the other side of the holes, again accelerated by the screen electrode, and finally bombard a corresponding pixel on the screen, thereby forming an image. The image has the advantage of good quality, high efficiency and low cost.

6 Claims, 1 Drawing Sheet

FIELD ION DISPLAY DEVICE

FIELD OF THE INVENTION

The invention relates to an electronic device, in particular, to a flat panel display device named field ion display (FID). It can be used as a color or a black-white display of television or computer, and also can be used as a display for pictures and characters in other situations.

BACKGROUND ARTS

At present, information technology is developing fast worldwide. As a window to exchange information between human and machine, display device plays a very important role in it. Up to now, cathode ray tube (CRT) can produce the highest quality image among all kings of display devices. However, CRT has the disadvantages of huge bulk and having to be paneled. The present flat panel displays, such as the liquid crystal display (LCD), the plasma display panel (PDP), the field emission display (FED), etc., due to their problems in principles and technologies, have the following common shortcomings: the image quality is not satisfactory and is not easy to produce. So the cost performance ratio is lower than that of CRT. For example, LCD can be used as a display device by using electric signal to change the arrangement of the molecules of the liquid crystal, to moderate the external light. Japan has developed the LCD to a considerable degree, occupying 99% of LCD market, but in many performance levels, LCD is lower than that of CRT. Moreover, the voltage and power consumption of a color LCD are not as low as indicated, because it needs a back light source when operating. PDP, as another example, produces ultraviolet ray by use of gaseous glow discharge, thereby stimulating the color fluorescent materials. As the light of gaseous glow discharge influences the color purity of fluorescent materials, and the pixels cannot be fabricated small enough to guarantee sufficient brightness, it is not possible to get the same color fidelity and resolution for PDP as that of CRT. Now most PDP is made as large screen TV with an area of about 1 square meter. As the cost performance ratio is lower than that of CRT, its prospect is not optimistic. As the most advanced flat panel display device, FED adopts the flat panel cold field emission tips array instead of the thermal emission electronic gun. It is the best scheme to turn CRT into a flat panel display, but to fabricate the tips array in homogeneous field emission distribution on a large area is very difficult, and the energy of electronic beam is too low, which can only stimulate the low voltage fluorescent materials instead of the high voltage ones. Therefore, the color fidelity of FED cannot reach the level of CRT. Although large amount of financial support and technological forces have been gathered to develop FED, its high cost and low quality of color image still prevent it from entering the market.

OBJECT OF THE INVENTION

To overcome the above shortcomings of the above flat panel display, the invention provides a flat panel display named field ion display FID, which can provide good quality image, with low cost and energy consumption.

SUMMARY OF THE INVENTION

To achieve the object of the invention, there is provided a field ion display device FID, which comprises: a fluorescent plate 3, a field ion emission plate 1 and a microchannel plate 2, the field ion emission plate 1, the microchannel plate 2 and the fluorescent plate 3 are arranged parallel to each other, with gaps there between and microchannel plate 2 arranged between the other two plates, and being peripherally sealed with a thin gas filled inside, wherein an X-line electrode system 4 is provided on the inner side of the field emission plate 1, each X-line electrode including a plurality of fine wedge shape lines connected parallel; a Y-line electrode system 5 is provided on the side of the microchannel plate 2 facing the field ion emission plate 1, an accelerating electrode 6 is provided on the other side of the micro-channel plate 2, each crossing point of the Y-line electrodes 5 on the micro-channel plate 2 and the X-line electrodes 4 on the field ion emission plate 1, is an addressing point of X-Y encoding. On those addressing points there are many microchannel holes 8 passing through the microchannel plate 2; On the inner side of the fluorescent plate, facing every addressing point high voltage fluorescent pixels 9 are provided, on which a thin aluminum film is deposited as a screen electrode 7.

Preferably, the substrates of the field ion emission plate 1 and microchannel plate 2 are made of insulating material, and the fluorescent plate 3 is made of transparent insulating material.

Preferably, the X-line and Y-line electrode systems 4 and 5 are addressed by X-Y encoding. The lead wires of the X-Y electrode systems, the accelerating electrode 6 and the screen electrode 7 are all left outside of the sealed field ion display to be connected with the driving circuits of the FID.

Preferably, the field ion display device is filled with thin gas ($10^{-4}$14 $10^{-5}$ tor).

To achieve the object of the invention, there is also provided a method for producing the field ion display device FID, the FID comprises a fluorescent plate 3, a field ion emission plate 1 and a microchannel plate 2, the method comprises the steps of: providing the X-line electrode system 4 on the inner side of the field ion emission plate 1, each X-line electrode is formed by many very fine wedge shape lines; providing the Y-line electrode system 5 one the side of the surface of the microchannel plate 2 facing the field ion emission plate 1; providing the accelerating electrode 6 on the other side of the microchannel plate 2, each crossing point of the Y-line electrode on the microchannel plate 2 and the X-line electrode on the field ion emission plate 1 is an addressing point, on those addressing points on the microchannel plate 2 there are many microchannel holes 8 passing through; providing, on the inner side of the fluorescent plate facing to the addressing points, the phosphorous pixels 9, which are alternated in order with three original colors, i.e. red, green and blue, on which a thin aluminum film is deposited as screen electrode 7, arranging the field ion emission plate 1, the microchannel plate 2 and the fluorescent plate 3 parallel to each other with gaps there between, the microchannel plate 2 being arranged between the other two plates, and sealing the above three plates peripherally with a thin inert gas filled inside ($10^{-4}$14 $10^{-5}$ tor). The X-line electrode system 4 and Y-line electrode system 5 are addressed by X-Y encoding.

Preferably, the field ion emission plate 1 and the microchannel plate 2 are made of insulating material and the fluorescent plate 3 of transparent insulating material.

The operation mechanism of FID:

As a signal voltage is applied to an addressing point (Xi,Yj), the positive field ions are emitted from the corresponding point on the field ion emission plate 3 based on the signal strength, then pass through the microchannel holes 8, impinge on the wall of the holes, so that the multifold secondary electron emissions are multiplied. The secondary electrons are accelerated by the accelerating electrode 6, converting into a strong electron flow, then are extracted from the other side of the holes, being accelerated again by the screen electrode 7, and finally bombard a corresponding pixel on the fluorescent plate 3, thereby stimulating the fluorescent light to produce an image.

The advantages of FID:

(1)Field ion emission is easier to realize than the field electron emission, so FID is easier to produce than FED. Furthermore, FID is cheaper to manufacture than FED, the cost of FID is of the same level as that of CRT.

(2)The microchannel plate of FID converts the ion emission beam into a high electron beam and stimulates the high-voltage fluorescent material, and also it can divide the colors of the signal just as the shielding plate does in CRT. Therefore, the color image quality can reach the level of CRT. Furthermore, the structure of FID is relatively simple and its cost is considerably low.

(3)FID makes use of the field ion cold emission and works in the self-exited dark discharge region of the gas, all of the energy consumed being used for accelerating the ions and electrons, so the efficiency of FID can reach the level of LCD.

(4)FID realizes very high image resolution, with 100 pixels per square mm. Therefore, FID can reach the level of FED.

(5)Increasing the diameter of the microchannel holes and the thickness of the microchannel plate, we can get a large area microchannel plate. Therefore, it is quite easy to realize a large screen display.

BRIEF DESCRIPTIONS OF THE ACCOMPANYING FIGURES

THE BEST WAY TO IMPLEMENT THE INVENTION

Figure 1:
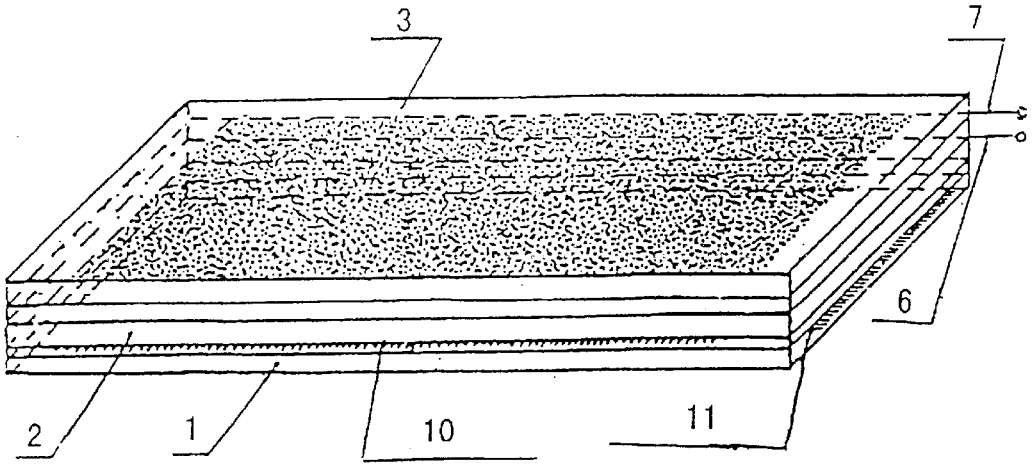
FIG. 1 is an overview of the structure of a FID.
Figure 2:
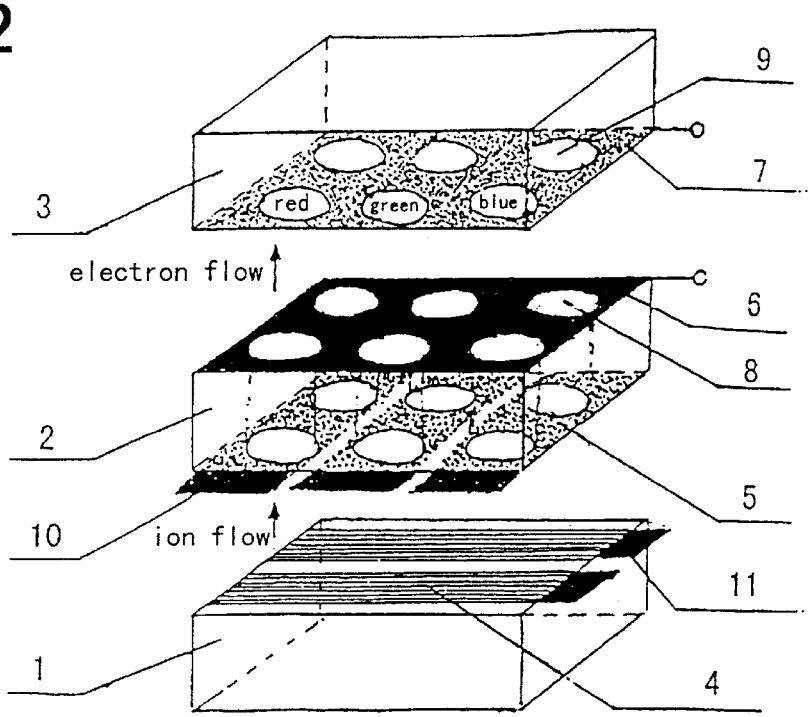
FIG. 2 is a partial view of the structure of FID.

In FIG. 1 and 2, the back plate 1 is a field ion emission plate, the cover plate 3 is a fluorescent plate, the inner plate 2 between the back plate 1 and the cover plate 3 is a microchannel plate. The above three plates are all made of insulating material, for instance, of glass.

On the inner side of the field ion emission plate 1, an X-line electrode system 4 is provided, each X-line electrode being formed by many (e.g. several decades) fine wedge shape lines with high curvature, and a thin metal film is deposited on them. The larger their surface power function the better. For example, we can deposit platinum film or graphite-like film on them to improve their surface work function.

On the side of the microchannel plate 2 facing the field ion emission plate 1, a Y-line electrode 5 is provided in the direction of the microchannel holes 8, and an accelerating electrode 6 is provided on the other side.

The crossing points of the Y-line electrodes on the microchannel plate 2 and the X-line electrodes on the field ion emission plate 1 are the addressing points. On the microchannel plate 2, at every addressing point, there are plurality of microchannel holes 8 with a diameter of several decades micro-meters passing through. These microchannel holes have an angle with the perpendicular line of the microchannel plate, which ranging from 5 to 20 degrees.

On the inner side is the fluorescent plate 3, facing every addressing point, pixels 9 with three original colors of high-voltage fluorescent materials are deposited. A thin aluminum film is deposited on them, forming the screen electrode 7.

As shown in FIG. 2, the field ion emission plate 1 and the microchannel plate 2 are located several $\mu$m apart from each other, the microchannel plate 2 and the fluorescent plate 3 several mm apart, these three plates being parallel to each other and the microchannel plate 2 being arranged between the other two plates and being peripherally sealed with a thin gas filled in as the imaging gas. The pressure of the gas is $10^{-4}$–$10^{-5}$ tor. We should select the inert gas with low ionization potential, high negative electron affinity and low atom number or mixed with a few other gases. All the lead wires of the electrodes should be kept outside of this device to be connected with the driving circuits. The overview of the structure of FID is shown in FIG. 1, in which numerical 10 represents the lead wires of the Y-line electrodes on the microchannel plate 2, and 11 that of the X-line electrodes on the field ion emission plate 1. This device is addressed with X-Y encoding.

The thickness of FID is about 5 to 20 mm, determined by the area of this panel display. On the field ion emission plate 1, the X-line electrode system 4 is fabricated by microelectronic technologies. The distance between the centers of two neighboring X-lines and the width of every X-line electrode are determined according to the resolution of the display needed. For example, if the resolution of the display is 100 pixels per square mm, then the distance between the central lines of two neighboring X-lines should be about 100 $\mu$m, and the width of each X-line electrode Translation of the amended pages of Amendment under Article 41 may be 60 $\mu$m. Clearly,the resolution of the display may be 9 pixels per square mm, Moreover, each X-line electrode comprises over ten paralleled wedge shape lines (in the width of 1–2 $\mu$m), for example, by depositing a thin metal film on them.

The thickness of the microchannel plate 2 is about 2 mm. On the side of the microchannel plate 2 facing the field ion emission plate 1, the Y-line electrode system 5 is provided. The distance between the centers of two neighboring Y-lines and the width of each Y-line equal correspondingly to that of the X-line electrode system 4. The crossing points of the Y-line electrodes and the X-line electrodes are the addressing points. Each addressing point contains a plurality of microchannel holes 8 in the diameter of 10–50 $\mu$m. The microchannel holes 8 pass through the microchannel plate with an angle 5 to 20 degrees perpendicular to the surface of the microchannel plate 2. On the other side of the microchannel plate 2, an accelerating electrode 6 is provided.

On the inner side of the, fluorescent plate 3, the pixels 9 in three original colors (red, green and blue) are provided, with each pixel facing each addressed point vertically. An aluminum film with thickness of 0.1 $\mu$m is deposited on them as the screen electrode 7, which also serves as a protecting layer and a reflecting layer for the fluorescent material. The manufacturing processes are substantially similar to that of CRT.

When an addressed point (Xi, Yj) is applied with bias and signal voltage, the field ions will be emitted from around the addressing point on the field ion emission plate 1. These emitted ions are accelerated by the field and impinged on the wall of the microchannel holes 8, stimulating multifold secondary electrons emissions, so that the flow is multiplied. These secondary emission electrons are then accelerated by the accelerating electrode 6, thus to become a strong electrons flow. After extracting from the other side of the holes, the strong electrons flow is accelerated again and focused by the screen electrode 7, and finally bombard on a corresponding pixel of the screen. The microchannel plate not only can convert the ion flow into a strong electrons flow, but also can divide the colors of the signal as the shielding plate does in CRT, through which the electron beam can bombard on the corresponding red, green and blue pixels, thereby producing a color image.

The inventive FID is filled with thin inert gas ($10^{-4}$–$10^{-5}$ tor), so the gas will not react chemically with other materials inside the FID. Moreover, the inert gas possesses negative electron affinity, its molecule is easy to loss an electron and forming a positive ion. As the electrons are accelerated by the field and bombard on the fluorescent plate, the positive ions will be accelerated on the opposite direction, so that the positive ions cannot bombard on the fluorescent plate and make damage to it.

In this embodiment, which has a diagonal of 150 mm, the DC reference voltage of each electrode is:

The X-line electrode system 4 on the field ion emission plate 1: +30V~300V.

The Y-line electrode system 5 on the microchannel plate 2: 0V.

The accelerating electrode 6 on the microchannel plate 2: +1000V.

The screen electrode 7 on the fluorescent plate 3: +1000V~+6000V.

The device is addressed by X-Y encoding. When the bias and signal voltage are applied between Xi-line and Yj-line, the gas molecules between the crossing point of Xi and Yj will be ionized, thereby forming a positive ion emission flow based on the signal strength.

With the multifold secondary electron emission multiplied of the microchannel holes 8 and the accelerating voltage applied on them, the positive ion emission flow become a strong electron flow.

With the high voltage of the screen plate 7, the energy of the strong electron beam is further increased, to stimulate the high-voltage color fluorescent material directly.

Using the color dividing function of the microchannel plate 2, color image display can be realized.

Increasing the diameter of the microchannel holes 8 and increasing the thickness of the microchannel plate 2 in proportion (1:40), so as to increase the surface area of the microchannel plate, we can realize large screen FID. The embodiment is only for the FID with diagonal of 150 mm. If the diagonal of FID is changed, the above-mentioned parameters should be amended accordingly.

Industry Availability

From the above contents, it can be concluded that FID will find a wide range of utilization because it is easy to produce, with low cost, high efficiency and high quality of color image.

What is claimed is:

1. A field ion display device, comprising a fluorescent plate, a field ion emission plate and a microchannel plate for converting an ion emission beam into an electron beam, said field ion emission plate, said microchannel plate and said fluorescent plate are arranged parallel to each other, with gaps there between, said microchannel plate being arranged between the other two plates, and being peripherally sealed with a thin inert gas with pressure $10^{-4}$–$10^{-5}$ torr filled inside, wherein X-line electrode system is provided on the inner side of said field ion emission plate, each X-line electrode including a plurality of fine wedge shape lines connected parallel; Y-line electrode system is provided on the side of said microchannel plate facing said field ion emission plate, an accelerating electrode is provided on the other side of said microchannel plate, each crossing point of said Y-line electrodes on said microchannel plate and said X-line electrode on said field ion emission plate, is an addressing point, on those addressing points there are many microchannel holes passing through said microchannel plate to simulate multi-fold secondary electron emission; on the inner side of said fluorescent plate, facing every addressing point high voltage fluorescent pixels are provided, on which a thin aluminum film is deposited as a screen electrode.

2. The field ion display device as claim 1, wherein the substrates of said field ion emission plate and said microchannel plate are made of insulating material, and said fluorescent plate of transparent insulating material.

3. The field ion display device as claim 1, wherein said X-line electrode system and Y-line electrode system arc addressed by X-Y encoding, lead wires of said X-line electrode system and said Y-line electrode system, and an accelerating electrode and an screen electrode are all left outside of the sealed field ion display.

4. A method of producing a field ion display device having a fluorescent plate, a field ion emission plate and a microchannel plate for converting an ion emission beam into an electron beam, comprising the steps of: providing a X-line electrode system on the inner side of said field ion emission plate, each X-line electrode is formed by many very fine wedge shape lines connected parallel; providing a Y-line electrode system on the side of the surface of said microchannel plate facing said field ion emission plate; providing an accelerating electrode on the other side of said microchannel plate, each crossing point of said Y-line electrode on said microchannel plate and said X-line electrode on said field ion emission plate is an addressing point, on those addressing points on said microchannel plate there are many microchannel holes passing through to simulate multi-field secondary electron emission; providing, on the inner side of said fluorescent plate facing to the addressing points, phosphorous pixels, which are alternated in order with three original colors, i.e., red, green and blue, on which a thin aluminum film is deposited as screen electrode; arranging said field ion emission plate, said microchannel plate and said fluorescent plate parallel to each other, with gaps there between and said microchannel plate being located between the other two plates, and sealing said three plates peripherally with a thin inert gas filled inside ($10^{-4}$–$10^{-5}$ torr).

5. The method of producing the field ion display device as claim 4, wherein: said field ion emission plate and said microchannel plate are made of insulating material and said fluorescent plate of transparent insulating material.

6. The method of producing the field ion display device as claim 4, wherein: said X-line electrode system and said Y-line electrode systems are addressed by X-Y encoding.

* * * * *